US005192218A

United States Patent [19]

Kuiper

[11] Patent Number: 5,192,218

[45] Date of Patent: Mar. 9, 1993

[54] LAMPHOLDER ASSEMBLY

[76] Inventor: Adrianus M. Kuiper, Lisstraat 27, Landsmeer, Netherlands, 1121 AR

[21] Appl. No.: 691,037

[22] PCT Filed: Oct. 22, 1990

[86] PCT No.: PCT/NL90/00159

§ 371 Date: Jun. 21, 1991

§ 102(e) Date: Jun. 21, 1991

[87] PCT Pub. No.: WO91/06991

PCT Pub. Date: May 16, 1991

[30] Foreign Application Priority Data

Oct. 23, 1989 [NL] Netherlands ..... 8902616

[51] Int. Cl.[5] ..... H01R 33/02

[52] U.S. Cl. ..... 439/226; 439/242

[58] Field of Search ..... 439/226-233, 439/235, 242, 243

[56] References Cited

U.S. PATENT DOCUMENTS

| | | | |
|---|---|---|---|
| 2,295,788 | 9/1942 | Hoeveler | 439/231 |
| 2,399,501 | 4/1946 | Mueller et al. | 439/231 |
| 2,595,487 | 5/1952 | Runge et al. | 439/231 |
| 2,597,060 | 5/1952 | Boutelle et al. | 439/242 |
| 4,643,504 | 2/1987 | Kuiper | 439/231 |

*Primary Examiner*—Larry I. Schwartz
*Assistant Examiner*—Hien D. Vu
*Attorney, Agent, or Firm*—Weingarten, Schurgin, Gagnebin & Hayes

[57] ABSTRACT

A lampholder assembly is provided for one or more fluorescent lamps having a single lamp cap, including at least one lampholder module. The lampholder module includes a lamp part for receiving the lamp and a narrower support part for supporting the lamp part, as well as at least one ballast. Only a relatively small and compact part of the lampholder assembly contains the electric components and connections, while the lampholder assembly is such that it can be built in or affixed quickly and easily.

10 Claims, 3 Drawing Sheets

LAMPHOLDER ASSEMBLY

FIELD OF THE INVENTION

This invention relates to a lampholder assembly for one or more fluorescent lamps having a single lamp cap, comprising at least one lampholder module, which lampholder module comprises a part for receiving the lamp (the lamp part) and a narrower part supporting the lamp part (the support part), as well as at least one ballast.

BACKGROUND OF THE INVENTION

A lampholder assembly of the type described above is known from European patent specification 0.151.598. That publication discloses in particular a lampholder assembly of which the ballast and the lampholder module proper can be assembled readily, owing to electric wiring built into the lampholder module. Optionally, the support part of the lampholder module can support two lamp parts, as is explained with reference to for instance FIGS. 4 and 5 of the European patent specification mentioned.

In practice, ballast and lampholder module will be incorporated in a larger whole, the fitting, which larger whole must be suitable to be built in or affixed. Such a construction often comprises a plurality of parts—namely, the component to be built in or affixed itself, containing the lampholder module and the ballast, and a covering member. The part that contains the electric components and connections must satisfy certain safety requirements. The quality-control institute designated by the electricity companies (KEMA in the Netherlands), is particularly concerned with the quality-control of said part and tends not to pay any attention to the covering part, which does not comprise any electric components or connections. Because in known constructions the lampholder module is often mounted on a part of the fitting and the ballast therebelow, a large part of that fitting (which term includes the entire "case" or "box") is subject to the safety requirements referred to above. Moreover, building in or affixing such constructions is laborious and time-consuming.

SUMMARY OF THE INVENTION

It is an object of the invention to provide a lampholder assembly in which only a relatively small and compact part contains the electric components and connections, while the assembly is such that it can be built in or affixed quickly and easily.

The object contemplated is accomplished according to the invention by providing a lampholder assembly which comprises a base plate for mounting thereon the lampholder module and the ballast, as well as a caplike member having a top surface which, when said caplike member has been mounted, is disposed in a plane below the lamp part of the lampholder module, which top surface has an opening provided therein formed to have a broad portion and an adjacent narrower portion, in such a way that at least the lamp part of the lampholder module can pass through said opening when the caplike member is being mounted, said opening further being provided in a location such that when the cap has been mounted, the support part of the lampholder module is disposed in the narrower portion of the opening, which narrower portion itself is narrower than the lamp part of the lampholder module, and a cover plate of suitable dimensions for covering the broader portion of said opening, which broader portion, when said cap has been mounted, is disposed before the support part of the lampholder module, there being provided means for attaching said cover plate, said caplike member and said base plate to each other. Thus, in the lampholder assembly according to the invention only the base plate and the lampholder module and ballast to be mounted thereon comprise electric components and connections so that in principle only those parts are subject to the safety requirements referred to. Any further parts of the whole to be mounted on the base plate can be constructed as desired and need not as a rule satisfy any requirements other than the user's. The base plate of the assembly according to the invention is preferably made of metal to ensure proper heat dissipation.

In one embodiment of the lampholder assembly according to the invention, which is suitable for affixation, the base plate is substantially flat and the caplike member is more or less box-shaped. In one embodiment, suitable for building in, the base plate comprises a deepened central portion, in which deepened portion the lampholder module and the ballast can be mounted, while the caplike member is substantially flat. The lampholder assembly according to the invention can be adapted for a single lampholder module and ballast, but may also be constructed with two or more lampholder modules with corresponding ballasts. This does not alter the principle of the construction—namely, a base plate with a cap having an opening in its top surface, the lamp part of the lampholder module(s) projecting above said top surface.

In a preferred embodiment of the lampholder assembly according to the invention, the caplike member is provided with an ornamental cover or means of attachment for mounting an ornamental cover or the like above the caplike member. This creates the possibility of using any ornamental cover. Such an ornamental cover will as a rule cover the lamp part of the lampholder module and the lamp to be mounted therein. It will be clear that many variants of such an ornamental cover are conceivable. The same, for that matter, holds for the caplike member itself, which may be of any desired colour or shape, and for the cover plate retaining the caplike member in mounted position on the base plate. This cover plate may suitably be constructed as a mirror, for instance. In another preferred embodiment of the device according to the invention, the base plate is provided with means of attachment for mounting additional electric components on the base plate. One example would be an electric switch.

BRIEF DESCRIPTION OF THE DRAWINGS

The invention will now be further explained and illustrated with reference to the accompanying drawings, in which.

In the Figures like parts are designated by like reference numerals.

DESCRIPTION OF THE PREFERRED EMBODIMENTS

Figure 1:
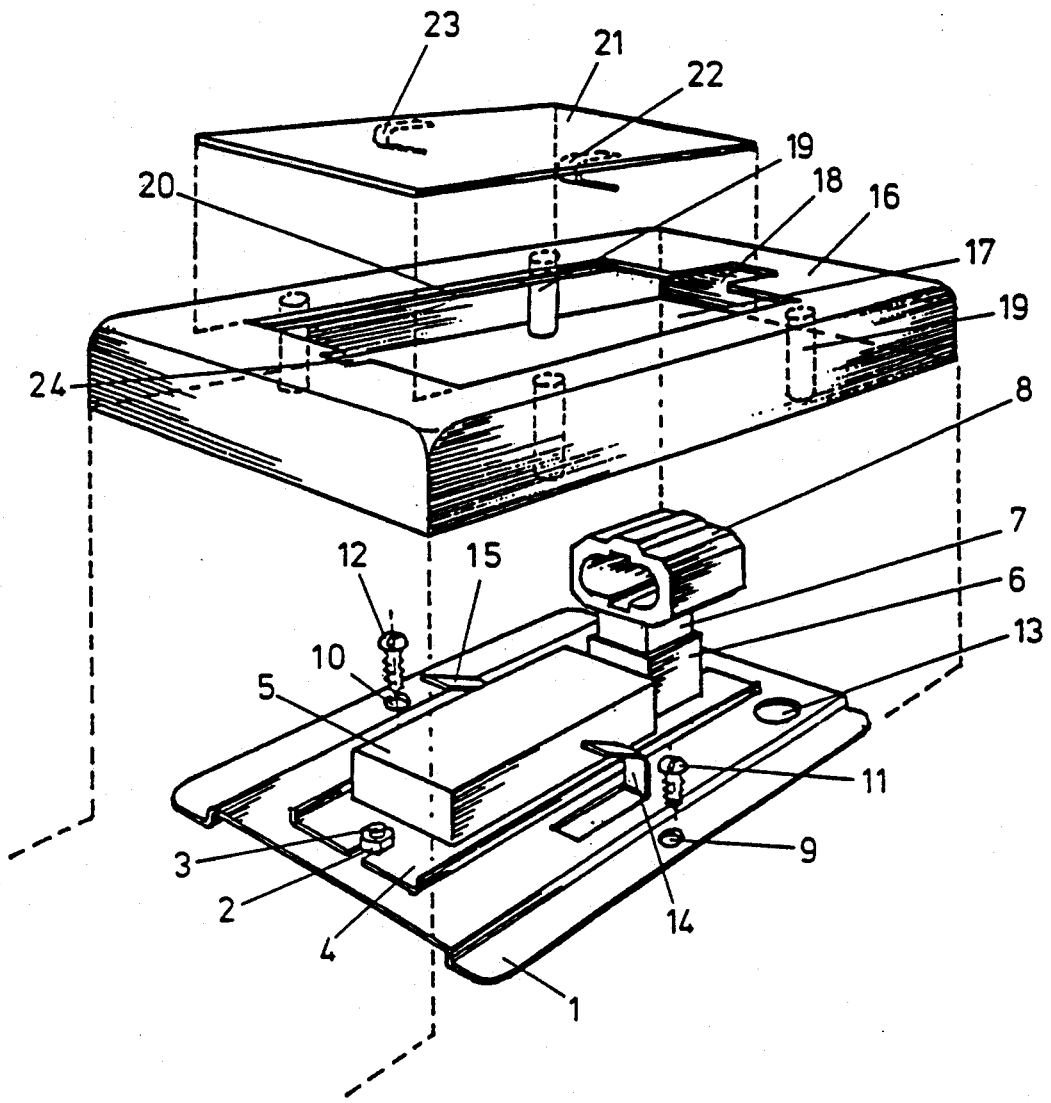
FIG. 1 is a partially exploded view of an embodiment of the lampholder assembly according to the invention.

The embodiment of the device according to the invention as shown in FIG. 1 comprises the more or less flat base plate 1, onto which the strip 4 is mounted by means of nut 2 and bolt 3, onto which strip 4 the ballast 5 and the lampholder module 6 are mounted. Lampholder module 6 and ballast 5 are plugged into each other in the manner disclosed in European patent specification 0.151.598 mentioned above. The lampholder module 6 comprises the cap part proper, into which the ballast 5 is plugged through the contact pins (not shown) mounted on the ballast, the support part 7 and the lamp part 8 for receiving a lamp of the PL-type.

As shown, the base plate 1 is not entirely flat in this embodiment, but slightly recessed in such a way that the central portion is raised relative to the sides.

The base plate 1 further comprises two bores 9 and 10 for passing screws 11 and 12 through so as to fixedly screw the base plate 1 to a wall or the like. Via an opening 13 the feed wires from a junction box in the wall or on the ceiling on which the bottom plate 1 is mounted, can be passed from under the raised central portion of the plate 1 to connecting points on the ballast 5 and/or lampholder module 6. Provided further on the base plate 1 on opposite sides of the strip 4 are a pair of clamps 14 and 15 mounted for a purpose to be described hereinafter.

The whole of base plate 1 and the ballast 5 and the lampholder module 6 mounted thereon comprises all electric components and wiring of the lampholder assembly, so that it is primarily that whole which is subject to the relevant safety requirements. The assembly can be further constructed in accordance with the requirements and wishes of the constructor.

The further construction of the embodiment shown in FIG. 1 comprises a more or less box-shaped cap 16, which after being mounted over the base plate 1 with its accessories, rests against the support surface on which the base plate 1 is mounted. The cap 16 is shown spaced away from the base plate 1. The relevant broken lines indicate its movement when it is being mounted. Provided in the top surface of the cap 16 is an opening comprising a rectangular broader portion 17 and an adjacent rectangular narrower portion 18. The dimensions of the narrower portion 18 of the opening in the top surface of the cap 16 are such that the support part 7 of the lampholder module 6 can properly fit into it. When the cap 16 is being mounted, it is moved in the direction of the base plate 1 so that the lamp part 8 of the lampholder module 6 extends through the broad portion 17 of the opening, projecting beyond the top surface of the cap 16. Then the cap 16 is moved in longitudinal direction until the support part 7 of the lampholder module 6 is exactly enclosed by the narrower portion 18 of the opening.

Mounted in the interior of the cap 16 are support members or legs 19, which are mounted on the inner side of the top surface. The legs 19 extend nearly as far as the bottom side of the sidewall of the cap 16 so that when a lampholder assembly that has not yet been mounted on a support surface is being handled, the base plate 1 will not sink into cap 16 since the legs will cause the cap 16 to rest on the unraised sides of the base plate 1.

The long sides of the broader portion 17 of the opening in the top surface of the cap 16 are constructed as a support edge 20 for supporting a cover plate 21 that otherwise fits exactly into that broader portion 17, which plate 21 is provided at the bottom side with two hooks 22 and 23 for coaction with clamps 14 and 15, respectively, provided on the base plate 1. The manner in which the cover plate 21 is mounted is schematically shown by broken lines. After cap 16 is mounted, the plate is placed in the broader portion 17 of the opening in such a way that the hooks 22 and 23 are positioned right before the clamps 14, 15. Then the plate 21 is slid in the direction of the support part 7 in the narrower portion 18 of the opening, until the plate 21 completely fills the broader portion 17 and the hooks 22 and 23 exactly engage in the clamps 14, 15. Thus the cover plate 21 is more or less fixedly attached to the base plate 1, thereby remaining the cap 16 in its proper position. For removing the cover plate 21 a recess 24 may be provided in the short side of the broader portion 17 of the opening opposite the side that the narrow portion 18 is adjacent to, for receiving a tool, for instance a screwdriver or a knife, so as to lift the cover plate 21 and then to slide it back so as to release the hooks 22 and 23 from the clamps 14 and 15, respectively.

What is left after the lampholder assembly is mounted is, as it were, a substantially flat and smooth box which is fixedly mounted on the support surface, only the lamp part 8 of the lampholder module 6 projecting therefrom. Then, as desired, before or after mounting the lamp in the lamp part 8 any ornamental cover can be mounted over or on the assembly. Such an ornamental cover which may be of any desired design, is not shown in FIG. 1, nor are the means of attachment required for such an ornamental cover. Anyone skilled in the art can think of such means of attachment. Such an ornamental cover may also, in whole or in part, be part of the cap 16 or the cover plate 21.

Figure 2:
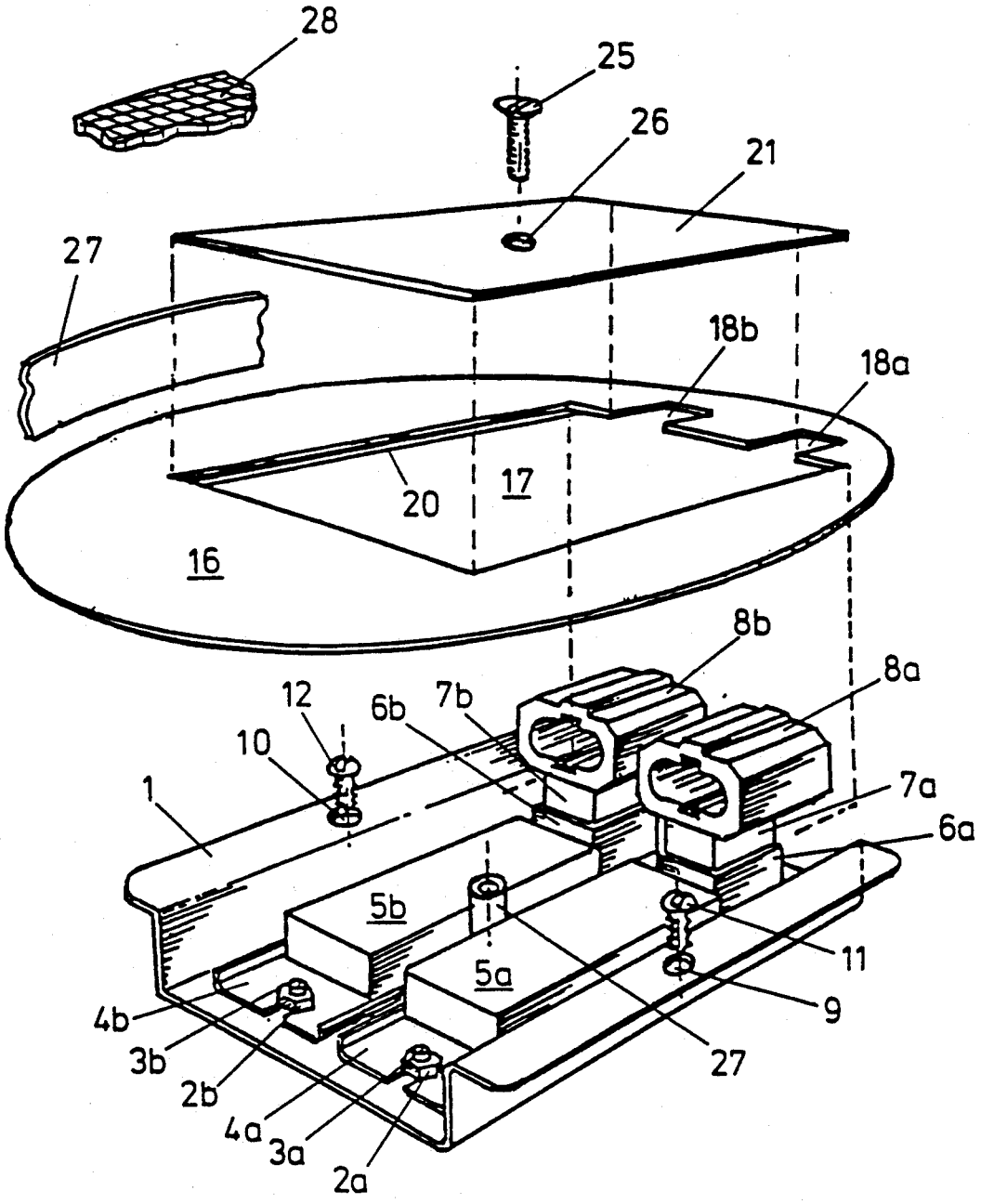
FIG. 2 is a similar view of another embodiment.

FIG. 2 shows an embodiment of the device according to the invention which is suitable to be built in and comprises two lampholder modules with corresponding ballasts.

The device according to FIG. 2 comprises a base plate 1 which is recessed in such a way that the central portion forms a deepened trough. In this deepened central portion of the base plate 1, the strips **4*a* and 4*b* are mounted by means of nut 2*a* and bolt 3*a* and nut 2*b* and bolt 3*b*, respectively. The strips 4*a* and 4*b* in turn support the respective ballasts 5*a* and 5*b* and the respective lampholder modules 6*a* and 6*b*, coupled thereto. The lampholder modules 6*a* and 6*b* comprise, arranged above the cap part proper, the support part 7*a*, 7*b* and the lamp part 8*a*, 8*b*. Provided in the long sides of the base plate are the openings 9 and 10 By means of screws 11 and 12 which extend through said openings 9 and 10, the base plate 1 can be secured to the support surface. In the case of building in, as contemplated, the deepened portion of the base plate 1 will be sunk into that support surface so that only the long sides rest on the support surface and in fact, of the assembly, only the support parts 7*a* and 7*b* and the lamp parts 8*a* and 8*b* of the lampholder modules 6*a* and 6*b*** project from the support surface.

The assembly of base plate 1 with the lampholder modules **6*a* and 6*b* and ballasts 5*a* and 5*b* mounted thereon, is largely covered by the cap 16, which in the embodiment according to FIG. 2 has the shape of a substantially flat plate. Provided in the cap or plate 16 is an opening comprising a rectangular broad portion 17 and adjacent, mutually interspaced, narrower portions 18*a* and 18*b*. To mount the cap or plate 16, it is moved in the direction of the base plate 1 so that the lamp parts 8*a* and 8*b* of the respective lampholder modules 6*a* and 6*b* extend through the broader portion 17 of the opening. Then the plate 16** is moved in longitudinal direction so that the support parts 7*a* and 7*b* of the respective lampholder modules 6*a* and 6*b* are exactly enclosed by the narrower portions 18*a* and 18*b* of the opening in the plate 16. The movement of the plate 16 is indicated in FIG. 2 by broken lines.

After the cap or plate 16 is mounted, the broader portion 17 of the opening is covered with the cover plate 21, which rests in the opening on the support edges 20 along the long sides of the broader portion 17 of the opening. The cover plate 21 is fixedly mounted on the base plate 1 by means of a screw 25 which is screwed through a hole 26 in the plate 21 into an internally threaded cylinder 27 which is fixedly mounted in the deepened portion of the base plate 1 between the ballasts 5*a* and 5*b*.

After assembly in the manner described hereinabove, the support surface is covered with the cap or plate 16 and only lamp parts 8*a* and 8*b* of the lampholder modules 6*a* and 6*b* project from that support surface and said plate 16. Onto this assembly, too, the desired ornamental covers or caps can be mounted. Such ornamental covers may also be part of the plate 16 in the cover plate 21. FIG. 2 shows a small section of the upright rim 27' and of the top surface 28 of such an ornamental cap, which may be of any kind. Any suitable manner of mounting such an ornamental cap is possible.

FIG. 2 shows a round cap or plate 16. It will be clear that in the build-in variant other forms can be used with the same effect. Similarly, in the variant according to FIG. 1 other caps than rectangular ones, for instance triangular or round ones, can be used.

Figure 3:
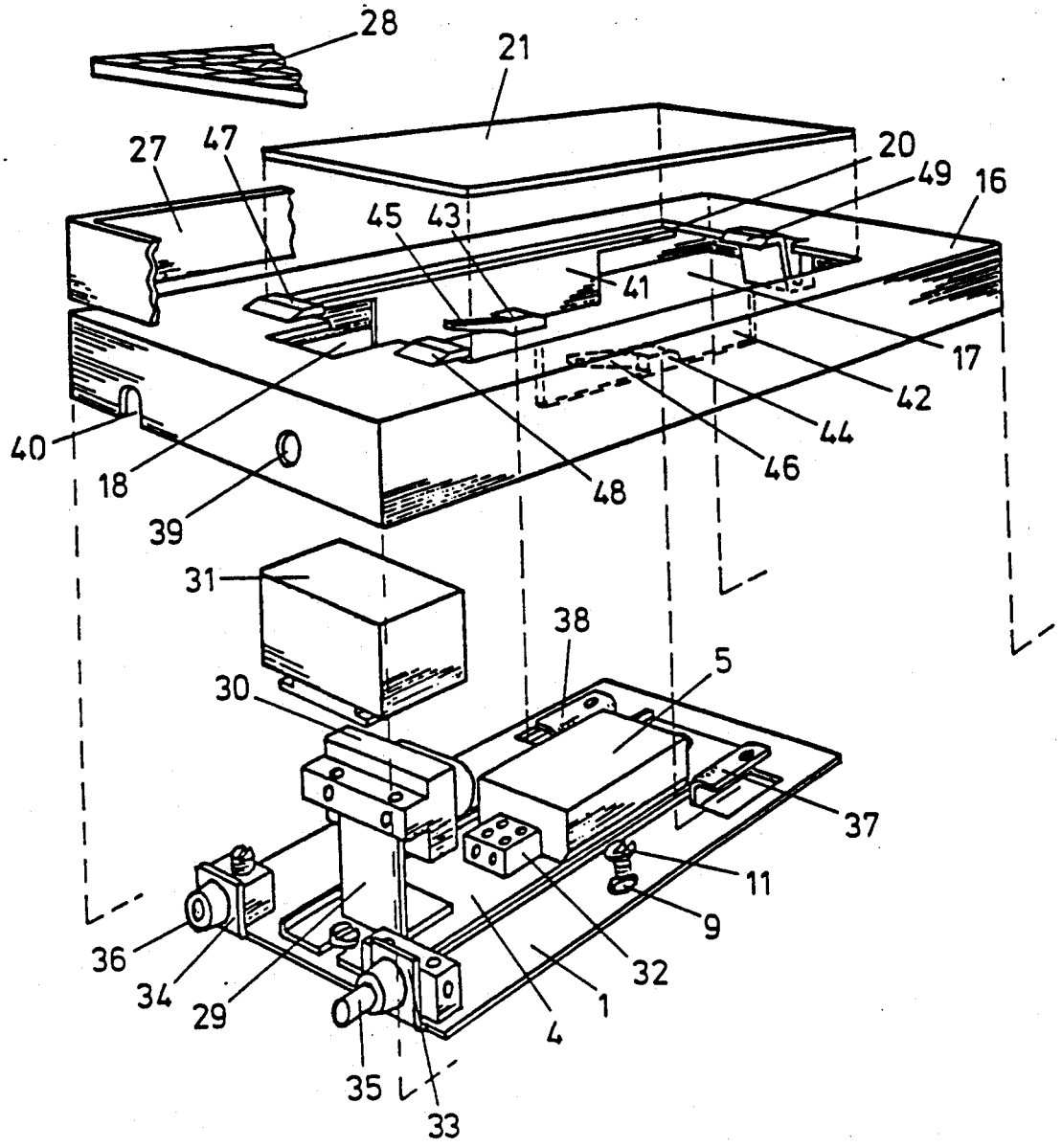
FIG. 3 is a similar view of yet another embodiment of the lampholder assembly according to the invention.

FIG. 3 shows yet another embodiment of the lampholder assembly according to the invention. This embodiment comprises the base plate 1 which is entirely flat in this case and is not recessed or raised. This base plate, too, is provided with openings for mounting the plate on a support surface by means of screws. FIG. 3 shows the opening 9 and the screw 11. Mounted on the base plate 1 is the strip 4, onto which the ballast 5 is mounted. Further mounted on the strip 4 is a bracket 29 mounting the lamp part proper 30, spaced from the strip 4. After mounting the cap 16 over base plate 1 and the parts mounted thereon, the lamp holder proper 30, projecting above the cap 16, can be encased by means of cap 31. Further mounted on strip 4 is a connector 32 for suitable realization of the interconnection of the electric wiring from power supply to lamp holder 30 and ballast 5.

Mounted on the front edge of the base plate 1 are two upright lugs 33 and 34, on which a pressure switch 35 (lug 33) and a pull relief 36 (lug 34) are mounted. At a suitable location on opposite sides of the plate 4 two upright brackets 37 and 38 have been forced out from the base plate 1, intended for mounting the cap construction to be discussed hereinafter.

The cap 16 referred to is more or less box-shaped in the embodiment shown in FIG. 3. Provided in the front wall of the box-shaped cap 16 is an opening 39 for the operating button of switch 35 to extend through in operation. Provided further in that wall is a recess 40 which in operation is positioned facing the pull relief 36 so that a flex can be passed therethrough to the base plate 1. Provided in the top surface of this cap 16, too, an opening is provided having a broader portion 17 and an adjacent narrower portion 18. Provided along the long sides of the broader portion 17 of the opening is a support edge 20, while along a part of the support edge 20 a downwardly directed strip 41, 42 is mounted. Provided at the bottom of the strips 41, 42 are means of attachment, each comprising a fixed block 43, 44 and a resilient part 45, 46 attached to the fixed block. When the cap 16 is being mounted, the attachment means coact with the brackets 37 and 38 on the base plate 1. As indicated by the broken lines, the cap 16 is mounted by moving it downwardly in the direction of the base plate 1 and then to slide it in longitudinal direction so that the switch 35 extends through the opening 39 and the attachment means 43, 45 and 44, 46, respectively are clamped under the brackets 38 and 37, respectively.

After the cap is mounted, only the lamp holder 30 itself along with the upper part of the bracket 29 extends beyond the top surface of the cap 16. The opening in the top surface of the cap 16 is closed by fitting the cover plate 21 therein, which is supported by the support edge 20 and is clamped in position by the fixed clamps 47 and 48 on the edge of the part of the cap 16 that is adjacent to the opening at the narrower portion 18 thereof, as well as by the resilient clamp 49 along the opposite edge of the opening.

On the box-shaped assembly thus constructed, too, ornamental covers can or may have been mounted, as desired. FIG. 3 schematically shows a part of the rim 27' and a part of the top surface 28 of such an ornamental cover.

It will be clear that without departure from the invention many further variants are conceivable.

I claim:

1. A lampholder assembly for one or more fluorescent lamps having a single lamp cap, comprising at least one lampholder module, which lampholder module comprises a part for receiving the lamp (the lamp part) and a narrower part supporting the lamp part (the support part), as well as at least one ballast, wherein the assembly comprises a base plate for mounting thereof the lampholder module and the ballast, as well as a caplike member having a top surface which, when said caplike member has been mounted, is disposed in a plane below the lamp part of the lampholder module, which top surface has an opening provided therein formed to have a broad portion and an adjacent narrower portion, in such a way that at least the lamp part of the lampholder module can pass through said opening when the caplike member is being mounted, said opening further being provided in a location such that when the cap has been mounted, the support part of the lampholder module is disposed in the narrower portion of the opening, which narrower portion itself is narrower than the lamp part of the lampholder module, and a cover plate of suitable dimensions for covering the broader portion of said opening, which broader portion, when said cap has been mounted, is disposed before the support part of the lampholder module, there being provided means for attaching said cover plate, said caplike member and said base plate to each other.

2. A lampholder assembly according to claim 1, wherein the base plate is provided with means of attachment for mounting additional electric components on said base plate.

3. A lampholder assembly according to claim 1, wherein the base plate is substantially flat and the caplike part is more or less box-shaped.

4. A lampholder assembly according to claim 3, wherein the caplike part is provided with an ornamental cover or with means of attachment to enable mounting an ornamental cover or the like above said caplike part.

5. A lampholder assembly according to claim 3, wherein the base plate is provided with means of attachment for mounting additional electric components on said base plate.

6. A lampholder assembly according to claim 1, wherein the base plate comprises a deepened central portion, in which central portion the lampholder module and the ballast can be mounted, while the caplike part is substantially flat.

7. A lampholder assembly according to claim 6, wherein the caplike part is provided with an ornamental cover or with means of attachment to enable mounting an ornamental cover or the like above said caplike part.

8. A lampholder assembly according to claim 6, wherein the base plate is provided with means of attachment for mounting additional electric components on said base plate.

9. A lampholder assembly according to claim 1, wherein the caplike part is provided with an ornamental cover or with means of attachment to enable mounting an ornamental cover or the like above said caplike part.

10. A lampholder assembly according to claim 9, wherein the base plate is provided with means of attachment for mounting additional electric components on said base plate.

* * * * *

UNITED STATES PATENT AND TRADEMARK OFFICE

CERTIFICATE OF CORRECTION

PATENT NO. : 5,192,218

DATED : March 9, 1993

INVENTOR(S) : Adrianus M. Kuiper

It is certified that error appears in the above-identified patent and that said Letters Patent is hereby corrected as shown below:

Column 1, line 27-28, "part-s-namely" should read --parts-namely--.

Column 4, line 11, "remaining" should read --retaining--.

Signed and Sealed this

Sixteenth Day of August, 1994

Bruce Lehman

*Attest:*

BRUCE LEHMAN

*Attesting Officer*

*Commissioner of Patents and Trademarks*